United States Patent [19]

Elger et al.

[11] 3,996,332

[45] Dec. 7, 1976

[54] SYNTHESIS OF RUTILE FROM TITANIFEROUS SLAGS

[75] Inventors: Gerald W. Elger; Donald E. Kirby, both of Albany, Oreg.

[73] Assignee: The United States of America as represented by the Secretary of the Interior, Washington, D.C.

[22] Filed: Dec. 2, 1975

[21] Appl. No.: 636,879

[52] U.S. Cl. ..... 423/69; 423/305; 423/610

[51] Int. Cl.[2] ..... C01G 23/04

[58] Field of Search ..... 423/610, 305, 315, 69

[56] References Cited

UNITED STATES PATENTS

| | | | |
|---|---|---|---|
| 3,739,061 | 6/1973 | Stickney | 423/610 |
| 3,914,381 | 10/1975 | Sugahara et al. | 423/305 |

FOREIGN PATENTS OR APPLICATIONS

| | | | |
|---|---|---|---|
| 39-20151 | 9/1964 | Japan | 423/610 |

*Primary Examiner*—Edward Stern
*Attorney, Agent, or Firm*—William S. Brown; Donald R. Fraser

[57] ABSTRACT

Synthetic rutile is produced from a titaniferous slag derived from ilmenite. Ilmenite concentrates are reduction smelted to remove iron as a high grade pig iron byproduct and to enrich the remaining slag phase in titanium. Oxidation of the slag and aging at high temperature in the presence of a titanium pyrophosphate flux converts the titanium bearing phases to discrete rutile crystals and a phosphate glass phase containing most of the associated impurities. Rutile is separated from the glassy matrix by attrition scrubbing aged, ground slag in dilute mineral acid solutions.

13 Claims, 1 Drawing Figure

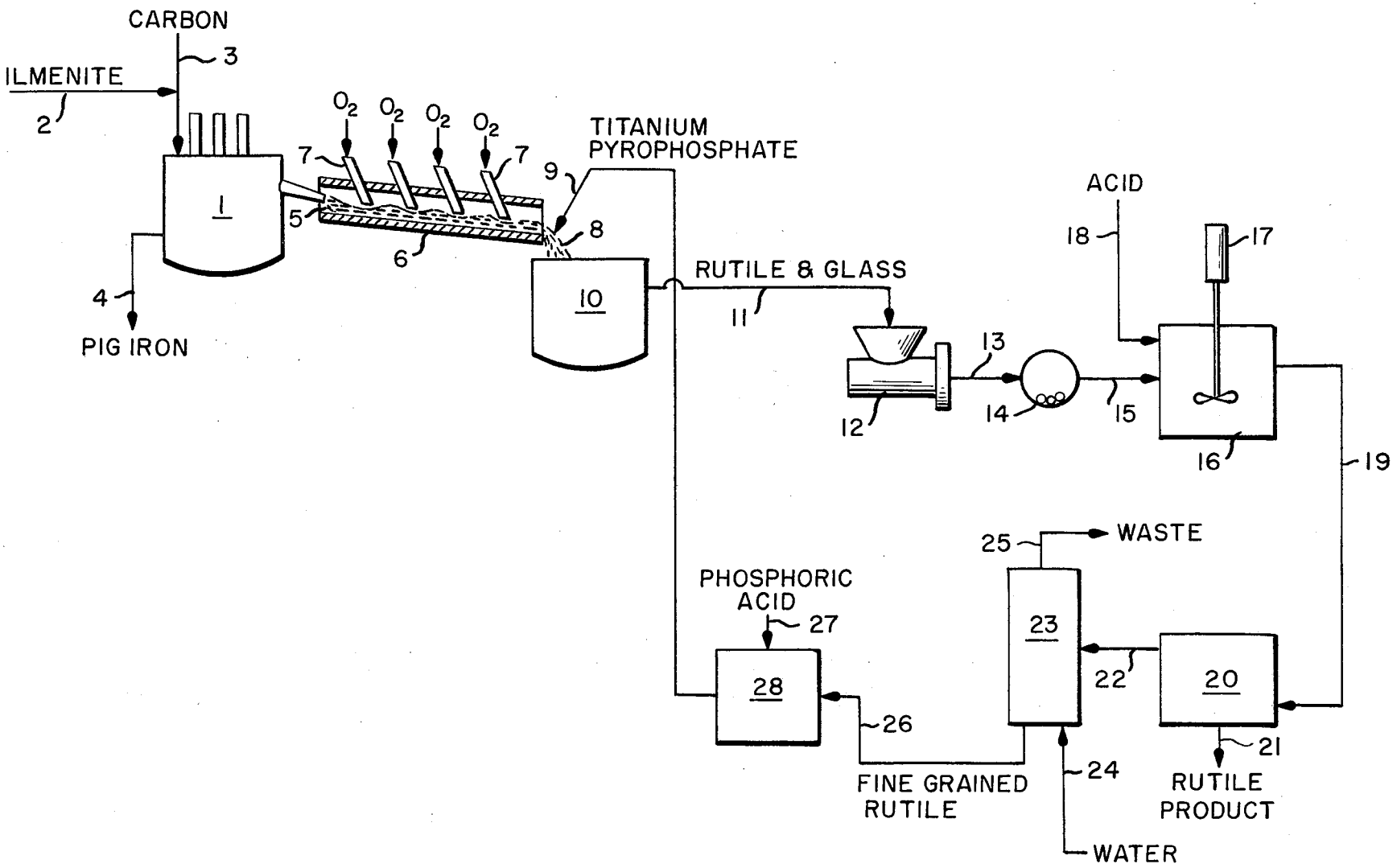
ILMENITE
2
CARBON
3
1
4
PIG IRON
5
6
7
7
$O_2$
$O_2$
$O_2$
$O_2$
TITANIUM PYROPHOSPHATE
9
8
10
RUTILE & GLASS
11
12
13
14
15
ACID
18
17
16
19
20
21
RUTILE PRODUCT
22
23
24
WATER
WASTE
25
FINE GRAINED RUTILE
26
PHOSPHORIC ACID
27
28

SYNTHESIS OF RUTILE FROM TITANIFEROUS SLAGS

BACKGROUND OF THE INVENTION

1. Field of the Invention

This invention relates to the treatment of titaniferous slags by oxidation and crystallization to recover a synthetic rutile product suitable for chlorination.

2. Description of the Prior Art

U.S. Pat. No. 3,739,061 discloses oxidation of titaniferous slag and the formation of rutile crystals using a phosphorus oxide fluxing agent. Rutile crystals were separated from a glassy matrix by grinding followed by attrition scrubbing in a phosphoric acid or ammonium oxalate solution.

The invention described and claimed herein has been disclosed in a publication entitled Synthesis of Rutile from Domestic Ilmenites, Elger, et al, U.S. Bureau of Mines Report of Investigations 7985, published on Dec. 13, 1974.

SUMMARY OF THE INVENTION

We have found that use of titanium pyrophosphate as a flux in the synthesis of rutile from titaniferous slags offers substantial advantages over those phosphorus compounds known and used before for this purpose. The flux is added to molten titaniferous slag at a temperature typically about 1500° to 1600° C. When phosphorus pentoxide or other phosphorus compounds which decompose at high temperature to form phosphorus oxides are added to slag at these temperatures, there occurs considerable fuming and loss of fluxing agent by sublimation. Titanium pyrophosphate is sufficiently stable to allow its addition to molten slag with essentially no fuming or loss.

The titanium pyrophosphate flux is produced by reaction of rutile with concentrated phosphoric acid. Rutile crystals synthesized from slags display a wide size range including a fine fraction which is unsuitable for use in a subsequent chlorination. This fine rutile fraction is utilized for the manufacture of the titanium pyrophosphate flux thus significantly increasing the overall rutile recovery from the process. Upon addition of the flux to molten slag, the titania moity of the flux becomes available for rutile crystal growth which the phosphorus oxide moity acts to dissolve slag impurities to form a weak and friable phosphate glass.

Hence, it is an object of our invention to synthesize rutile from titaniferous slags.

A specific object of our invention is to provide a superior flux for use in rutile synthesis.

BRIEF DESCRIPTION OF THE DRAWING

The lone FIGURE depicts a diagrammatic flow sheet of a process for synthesizing rutile from a titaniferous slag derived from the smelting of ilmenite. The flow sheet will be described in detail later.

DESCRIPTION OF THE PREFERRRED EMBODIMENTS

Our process broadly consists of three basic steps. First, a suitable titaniferous ore or concentrate such as ilmenite is smelted using a carbon reductant to remove and recover most of the iron contained in the ore as pig iron leaving a titania-enriched slag of low-iron content. Second, the slag is oxidized to convert substantially all of the titanium oxides to the dioxide. Oxidized slag is then aged, or held, at elevated temperatures to allow growth of rutile crystals. Either before or after oxidation but before aging, a titanium pyrophosphate flux is added to the slag in sufficient amount to dissolve most of the slag impurities with the formation of a phosphate glass matrix. Third, the rutile crystals are liberated from the matrix by mechanical means and chemical dissolution of the glass impurity. Rutile of a crystal size too small for use as a feedstock for chlorination is reacted with phosphoric acid to produce the titanium pyrophosphate flux.

A titaniferous slag suitable for use in our process may be produced by smelting titanium ores such as ilmenite or titaniferous magnetite. Smelting conditions are generally conventional except that the slag produced must meet certain requirements as to composition. The iron content of the slag, reported as FeO, should be kept well below 10% as high iron slags (10–13% FeO) do not respond effectively to rutile synthesis. Optimum iron content of the slag is in the range of about 3 to 5 wt-pct FeO. Titanium oxides content of the slag should be maintained at as high a level as possible. A titanium oxide content of 60 wt-pct is about the minimum which can be successfully utilized in our process because there is formed at lower levels a titanium calcium silicate having a stable spinel structure. Formation of the spinel reduces the yield of rutile.

Acceptable slag may be produced from ilmenite concentrates by electric furnace smelting using coke or other forms of carbon as the reductant. It is preferred, although not necessary, to blend the ilmenite concentrate with carbon and a small amount of calcium oxide flux and then to pelletize the mixture using appropriate binders. Carbon requirements are about 125 to 150% of stoichiometric based upon the total reduction of iron oxides contained in the concentrate to elemental iron with carbon going to the monoxide and on the saturation of the iron product with 3.5 to 4 wt-pct carbon. The calcium oxide or lime flux is added in an amount equivalent to about 2 to 5 wt-pct of the ilmenite charged. Purpose of the flux is to increase the slag fluidity so as to perform the smelting step at lower temperatures and to facilitate the later processing of the slag. Slag liquidus temperatures will usually range from about 1300° to 1400° C when flux is used. It is possible to reduce residual iron oxides to levels substantially below 3% but such a severe reduction also results in the reduction of titanium dioxide to lower valent titanium oxides causing a significant increase in the slag liquidus temperature. Such an over-reduction also complicates the later processing step in which lower valent titanium oxides are oxidized to the dioxide. A detailed description of the electric furnace smelting of ilmenite concentrates may be found in the Bureau of Mines Report of Investigations 5170 (1955).

Molten slag is tapped from the furnace and is transferred to an oxidation launder or other appropriate contacting device and is there contacted or blown with air, oxygen enriched air or oxygen. The amount of oxygen requires is on the order of 150 to 200% of the stoichiometric requirements for oxidation of $Ti_2O_3$ to $TiO_2$, FeO to $Fe_2O_3$ and C to $CO_2$. When using oxygen, the reaction is quite rapid and may be carried to substantial completion in a launder of sufficient length to allow a contact time of about 10 seconds to 1 minute. Although the reaction is exothermic, the slag must be maintained above its liquidus temperature, preferably in the range of 1400° to 1700° C during oxidation, and care must be taken to avoid excessive heat loss. For this reason, oxygen is preferred so as to avoid the cooling effect of nitrogen contained in air.

The titanium pyrophosphate flux may be added prior to, during, or directly after the oxidation step. Titanium pyrophosphate is a relatively stable solid but it decomposes readily at slag oxidation temperatures to form titanium dioxide and phosphorus oxide. The titanium dioxide is available for rutile crystallization while phosphorus oxide dissolves slag impurities to form a weak and friable glass. By addition of the phosphorus oxide in the form of titanium pyrophosphate, fuming of the flux is negligible. In contrast, if the phosphorus oxide flux is added in the form of $P_2O_5$, which is reported to sublime at about 300° C, flux losses by sublimation amount to some 10 to 15%. Amount of flux required is of course related to the amount of gangue impurities contained in the slag. Appropriate flux additions are in the range of 2 to 10 wt-pct $P_2O_5$ equivalent based upon slag weight. In most cases, flux additions in the range of about 4 to 9% are optimum.

After oxidation and flux addition, the slag is aged, or held, at high temperature for a period of time sufficient to allow growth of rutile crystals. Crystal growth will occur at temperatures as low as about 650° to 800° C but crystals produced at those temperatures are too small in size to constitute a desirable product and to allow practical recovery. It is preferred that the slag be aged at temperatures above 1200° and most preferably at temperatures above the slag liquidus temperature for a time in the range of about 0.5 to 5 hours. Under these conditions, there is realized an optimum yield of rutile crystals having an average size of about 100 to 150 microns.

Liberation of rutile crystals from the phosphate glass matrix is accomplished by a combination of physical and chemical means. At the conclusion of the aging step, the slag may be cooled and then crushed. Alternatively, aged, liquid slag may be water-quenched to granulate the slag. Thereafter, the crushed or granulated slag is subjected to a coarse grinding step to further comminute the slag and to partially physically liberate rutile crystals. The glassy matrix is then dissolved by attrition scrubbing with a mineral acid. Sulfuric acid is preferred and acid requirements are 0.2 to 0.3 parts sulfuric acid per part of slag. Relatively dilute sulfuric acid having a concentration of about 4 to 8 wt-pct is satisfactory for this purpose.

Referring now to the drawing, the FIGURE comprises a diagrammatic flow sheet of our process. An electric furnace 1 is charged with a titanium ore such as ilmenite 2 and a carbon reducing agent such as coke 3. A fluxing agent such as lime may be added preferably as a blend with the ilmenite to reduce the liquidus temperature of the slag. Smelting is continued until the FeO content of the slag is reduced to a level of about 3–5 wt-pct. A pig iron fraction 4 is then tapped from the furnace. Pig iron 4 will typically analyze about 95% Fe with 3–4% carbon.

Slag 5 is then tapped from the furnace at a temperature well above its liquidus temperature and is immediately contacted with an oxygen containing gas, preferably oxygen, for a time sufficient to convert substantially all of the lower oxides of titanium to $TiO_2$. Oxidation may be carried out in a launder 6 having multiple oxygen lances 7. Alternatively, oxidation may be accomplished by the oxygen lancing of molten slag in a ladle or holding furnace. Fully oxidized slag 8 is then admixed with a titanium pyrophosphate flux 9 and is aged in holding furnace 10 to allow growth of rutile crystals. The titanium pyrophosphate flux decomposes at slag temperatures to yield titanium oxide and phosphorus oxides. There occurs a reaction between the phosphorus oxides and gangue constituents of the slag to form a mechanically weak and friable phosphate glass while the titanium content of the flux is released for rutile formation.

It is preferred that the slag be maintained in the molten state during aging. Time required for rutile crystal growth is ordinarily in the range of about 0.5 to 5 hours. After crystal growth is complete, the slag may be allowed to solidify and cool in furnace 10 after which the rutile crystals in the phosphate glass matrix 11 may be crushed in means 12. Crushing means 12 may comprise any conventional type of primary crusher such as a jaw crusher or the like. Alternatively, aged molten slag may be tapped from holding furnace 10 and water granulated. The crushed or granulated slag is then transferred via means 13 to mill 14 where it is subjected to a coarse grind in a rod mill or similar device. Fine grinding is unnecessary; grinding to 100% minus 28 mesh produces completely satisfactory results.

The ground slag is then transported via conduit 15 to attrition scrubbing means 16 which is equipped with agitation means 17. There, an aqueous slurry of ground slag is treated with acid which is introduced into attrition scrubber 16 by way of conduit 18. Phosphate glass matrix material is dissolved by the acid thus freeing rutile crystals. It is preferred to accomplish the attrition scrubbing step at moderately elevated temperatures; in the range of about 50° to 90° C. Contact time required in means 16 depends upon the phosphate glass concentration in the slag, upon temperature, degree of agitation and acid concentration but will generally range from about 1 to 2 hours.

Slurry from the attrition scrubber is then transferred by way of line 19 to a thickener or settler 20. Underflow stream 21 from the thickener constitutes the rutile product while the overflow stream 22 comprises a suspension of very fine rutile crystals and fragmented glass particles. Overflow stream 22 is next subjected to a separation step which preferably comprises water elutriation in which the very fine rutile crystals are separated from the lighter glass fragments. The elutriation separation may be accomplished in column 23 in which an upflowing water stream 24 entrains light glass fragments which are disposed of as waste stream 25 while the denser rutile crystals are removed from the bottom of the column via line 26. Rutile crystals recovered in the elutriation step are very small, typically finer than 400 mesh, and are unsatisfactory for use as a chlorination feedstock. Hence, this fraction is utilized for the production of the titanium pyrophosphate flux by reaction with concentrated phosphoric acid stream 27 in vessel 28. The reaction is carried out using an approximate 1 to 1 molar ratio of phosphoric acid to rutile at temperatures in the range of 300° to 550° C for a time sufficient to complete the reaction; usually in the range of 1 to 12 hours. Titanium pyrophosphate product is then crushed and ground if necessary and is introduced into the oxidized, molten slag via means 9.

The following examples illustrate specific embodiments of our invention.

EXAMPLE 1

A sample of ilmenite concentrate was obtained from an alluvial deposit in Idaho and a second sample of ilmenite concentrate was obtained from a massive deposit at the Tahawas mine in New York State. The chemical composition of the two concentrates in wt-pct was as follows:

| Constituent | Source | |
|---|---|---|
| | Idaho | New York |
| $TiO_2$ | 33.2 | 45.2 |
| FeO | 29.8 | 37.5 |
| $Fe_2O_3$ | 27.6 | 7.1 |
| MnO | 3.2 | 0.2 |
| $SiO_2$ | 3.2 | 3.7 |
| $Al_2O_3$ | 1.0 | 2.1 |
| CaO | 1.0 | 0.1 |
| MgO | 0.1 | 2.6 |

Furnace charges were prepared from both samples using an amount of carbon equivalent to 125% of stoichiometric requirements for the Idaho ilmenite and 150% of stoichiometric requirements for the New York ilmenite. Five wt-pct of lime flux was added to the Idaho ilmenite charge and 2.5 wt-pct lime was added to the New York ilmenite charge.

The charges were smelted separately in an electric furnace and iron content of the slag was monitored by spectrographic analysis of bath samples. When the iron content in the slag was reduced to desired levels, the furnace products were tapped and there was recovered a pig iron fraction analyzing approximately 95% Fe and a titaniferous slag. Tapping temperatures ranged from 1515° to 1640° C. A chemical analysis of the two slags is as follows:

| Constituent | Source | |
|---|---|---|
| | Idaho | New York |
| $TiO_2$ | 59.8 | 42.0 |
| $Ti_2O_3$ | 6.9 | 31.8 |
| FeO | 3.4 | 3.3 |
| MnO | 7.0 | 0.6 |
| MgO | 3.3 | 5.0 |
| $SiO_2$ | 6.7 | 6.5 |
| $Al_2O_3$ | 5.0 | 4.1 |
| CaO | 4.6 | 2.7 |

X-ray diffraction data showed that the titanium in the slag occurred in three principal phases; titaniferous psuedobrookitetype crystals, calcium titanate and noncrystalline glass. Only trace amounts of rutile were detected.

EXAMPLE 2

A titaniferous slag produced by smelting ilmenite concentrates as described in Example 1 was determined to have a $Ti_2O_3$ content of about 56 wt-pct. The slag was tapped directly from the furnace at a temperature of about 1600° C into a preheated launder where it was treated directly with oxygen introduced into the launder through lances. The launder had a length of only 5 feet and residence time of the slag in the launder was but 2 to 5 seconds. After this brief treatment, the $Ti_2O_3$ content was reduced to 27 wt-pct. No difficulty was encountered in keeping the slag molten during oxidation.

Oxidized slag was transferred from the launder to a holding furnace. Oxidation was completed in the furnace by injecting oxygen through two gas spargers at a depth of 12 inches beneath the surface of the slag pool. Oxidation was essentially complete in 10 minutes.

EXAMPLE 3

Samples of oxidized slag prepared as in Example 2 were maintained at temperatures of about 1500° C in a holding furnace. Fluxing agents consisting of solid $P_2O_5$ and titanium pyrophosphate were added to separate samples of the molten slag. Some 11 wt-pct of the $P_2O_5$ flux was lost by sublimation during the addition while titanium pyrophosphate was added to the molten slag with essentially no fuming or loss.

EXAMPLE 4

Oxidized slag prepared as described in Example 2 was fluxed with titanium pyrophosphate in amounts ranging from about 5 to 9 wt-pct $P_2O_5$ equivalent based upon slag weight. The fluxed slag was aged for 2 hours at temperatures of about 1500° C and allowed to cool. Cooled slag was then crushed and ground to minus 28 mesh, leached in a mineral acid for 1 hour at 100° C and then attrition scrubbed for 5 minutes. The resulting slurry was decanted to recover a rutile product fraction having an average crystal size of about 120 microns. Recovery of titanium in this product fraction ranged between 80 and 88% of that contained in the slag. The rutile product analyzed 92 to 96% $TiO_2$ with iron oxide (hematite) and alumina being the major impurites.

The decantate, comprising a suspension of very fine rutile crystals and glass fragments, was transferred to an elutriation column and treated with water to separate the impurities from a minus 400-mesh rutile fraction. Overall rutile recovery obtained in the two rutile fractions was approximately 95%.

EXAMPLE 5

Very fine rutile crystals recovered by water elutriation as described in Example 4 were blended with concentrated phosphoric acid in approximately a 1 to 1 molar ratio and digested for about 12 hours at temperatures in the range of 450° to 550° C. The titanium pyrophosphate product contained approximately 60 wt-pct $P_2O_5$. It was ground to minus 65 mesh and blended with slag charges as a fluxing agent.

EXAMPLE 6

Rutile samples produced from both Idaho and New York ilmenite were evaluated as chlorination feedstocks in comparison to natural rutile. By screen analysis, about 60% of the synthetic rutile and 98% of the natural rutile was plus 200 mesh in size.

Small-scale, static-bed tests indicated that synthetic rutile chlorinated at about 1 ½ to 2 times the rate of natural rutile at temperatures of 850° to 900° C. It was also observed that onset of chlorination occurred at temperatures about 80° C lower with synthetic rutile than with natural rutile. However, no significant differences in chlorination rate were observed in fluid-bed tests of synthetic rutile as compared to natural rutile. Total conversion of rutile to titanium tetrachloride generally exceeded 95%.

We claim:

1. A method for synthesizing rutile from a titaniferous slag containing at least 60 wt-pct titanium oxides and less than 10 wt-pct ferrous oxide which comprises:

oxidizing the slag to convert substantially all lower titanium oxides to $TiO_2$;

mixing with the slag a titanium pyrophosphate flux in an amount ranging from 2 to 10 wt-pct $P_2O_5$ equivalent based upon slag weight;

aging the mixture at a temperature above 1200° C for a time sufficient to grow rutile crystals and to form a phosphate glass matrix, and separating rutile crystals from said phosphate glass matrix.

2. The process of claim 1 wherein said mixture is aged at a temperature above the liquidus temperature of said slag.

3. The process of claim 2 wherein the amount of titanium pyrophosphate flux added to the slag ranges from 4 to 9 wt-pct $P_2O_5$ equivalent based upon slag weight.

4. The process of claim 3 wherein the ferrous oxide content of said slag is in the range of 3 to 5 wt-pct.

5. The process of claim 4 wherein the aged slag mixture is cooled, comminuted and reacted with a mineral acid to dissolve the phosphate glass matrix and to free rutile crystals.

6. The process of claim 5 wherein the mineral acid is dilute sulfuric acid.

7. The process of claim 5 wherein the acid-treated slag mixture is decanted to recover a coarse, crystalline rutile product fraction suitable for chlorination.

8. The process of claim 7 wherein the decantate is subjected to a further separation to recover a very fine, crystalline rutile fraction.

9. The process of claim 8 wherein the fine, crystalline rutile is reacted with concentrated phosphoric acid at temperatures above about 350° C to produce titanium pyrophosphate.

10. The process of claim 9 wherein said titanium pyrophosphate is comminuted and is mixed with said titaniferous slag as a flux.

11. The process of claim 1 wherein the titaniferous slag is produced by smelting an iron-containing ore of titanium.

12. The process of claim 11 wherein said ore is ilmenite.

13. The process of claim 1 in which the titanium pyrophosphate flux is prepared by reacting minus 400-mesh rutile with concentrated phosphoric acid at a temperature of about 300° to 550° C.

* * * * *